US005309884A

United States Patent [19]

Fukui et al.

[11] Patent Number: 5,309,884

[45] Date of Patent: May 10, 1994

[54] INTERNAL COMBUSTION ENGINE CONTROL APPARATUS WITH IGNITION COIL DIAGNOSIS FUNCTION

[75] Inventors: Wataru Fukui; Toshio Ohsawa, both of Himeji, Japan

[73] Assignee: Mitsubishi Denki Kabushiki Kaisha, Tokyo, Japan

[21] Appl. No.: 16,558

[22] Filed: Feb. 11, 1993

[30] Foreign Application Priority Data

Feb. 19, 1992 [JP] Japan ..... 4-032007

[51] Int. Cl.[5] ..... F02P 15/00

[52] U.S. Cl. ..... 123/481; 123/630; 324/388

[58] Field of Search ..... 123/481, 630; 324/380, 324/388, 399

[56] References Cited

U.S. PATENT DOCUMENTS 4,117,807 10/1978 Barnard ..... 123/478
4,762,106 8/1988 Blauhut ..... 123/425
4,886,029 12/1989 Lill et al. ..... 123/630 X
4,969,443 11/1990 De Biasi ..... 123/630 X
4,987,771 1/1991 Iwata ..... 123/481 X
5,046,470 9/1991 Entenmann et al. ..... 123/481
5,239,973 8/1993 Murata et al. ..... 123/643 X

*Primary Examiner*—Tony M. Argenbright
*Attorney, Agent, or Firm*—Sughrue, Mion, Zinn, Macpeak and Seas

[57] ABSTRACT

An engine control apparatus capable of detecting occurrence of abnormality in the ignition coil with high reliability. The apparatus includes an initial detection level hold device for holding an initial level (In) of a detected ion current value I, and an ignition coil diagnosis device for generating an abnormality decision signal of the ignition coil in dependence on the initial level of the ion current. By positively utilizing noise produced in an initial phase of the ignition cycle instead of eliminating it, the abnormality decision signal is generated, on the basis of which an appropriate engine protection measure is taken.

6 Claims, 3 Drawing Sheets

INTERNAL COMBUSTION ENGINE CONTROL APPARATUS WITH IGNITION COIL DIAGNOSIS FUNCTION

BACKGROUND OF THE INVENTION

1. Field of the Invention

The present invention relates generally to an apparatus for controlling an internal combustion engine (hereinafter referred to simply as the engine) by correcting control parameters on the basis of a detected value of an ion current produced within an engine cylinder in a combustion cycle. More particularly, the present invention is concerned with an engine control apparatus which is imparted with a function for making decision as to occurrence of abnormality in an ignition coil with a high reliability.

2. Description of the Related Art

In the engine having a crankshaft driven by a plurality of engine cylinders and a camshaft interlocked with the crankshaft, a reference position signal generated in synchronism with the rotation of the engine is utilized for determining a variety of timings for the engine controls such as an ignition timing, a fuel injection timing and so forth. To this end, an angular position detecting means which serves for generating a reference position signal is mounted on the crankshaft or the camshaft at such a position that the reference position signal as generated indicates a predetermined reference position which corresponds to a predetermined crank angle (i.e., angle of rotation of the crankshaft).

When a misfire phenomenon occurs within an engine cylinder in the ignition cycle, resulting in no satisfactory explosion or combustion, abnormal explosion known as the after-burn will take place after lapse of the ignition cycle, involving injury of the engine cylinder and/or damage of a catalyst employed for catalytic treatment of the exhaust gas due to the contact with an uncombusted gas (i.e., air-fuel mixture undergone no combustion). Under the circumstances, a variety of measures have heretofore been proposed and adopted in an attempt for avoiding the misfire to thereby protect the engine and the catalyst.

For a better understanding of the background techniques of the invention, an engine control apparatus known heretofore will be described in some detail by reference to the drawings.

FIG. 3 is a functional block diagram showing a general arrangement of a conventional engine control apparatus.

Referring to the figure, a reference numeral 1 denotes an angular position detecting means which is usually constituted by a toothed disk mounted on a camshaft for rotation together with the shaft and a sensor installed in opposition to the disk for generating a pulse-like reference position signal T$\theta$ at a reference position corresponding to a predetermined crank angle for the associated cylinder in synchronism with the revolution of the engine. Usually, the reference position is set at B75° (i.e., at a position 75° before the top dead center) or B5°. A reference numeral 2 designates collectively a variety of sensors for acquiring various engine running state information D such as an intake air flow (or an opening degree of a throttle valve) indicative of a load of the engine, a rotation speed (rpm) of the engine, an intake air temperature and so forth. Further, an ion current detecting means 20 is provided for detecting an ion current I generated within the associated engine cylinder immediately after the combustion. The detected ion current value I is utilized for deciding or determining the combustion state within the associated engine cylinder. A reference numeral 3 generally denotes a control unit which is usually constituted by a microcomputer and which includes an engine control parameter setting means 31 for arithmetically determining a control parameter Ta for each engine cylinder on the basis of the reference position signal T$\theta$ and the engine running state information or signals D mentioned above. The control parameter setting means 31 includes a misfire detecting means for detecting the misfire event on the basis of the reference position signal T$\theta$ and the detected ion current value I. The engine control parameter setting means 31 is designed for generating as the engine control parameter Ta a control timing signal which corresponds, for example, to the ignition timing and at the same time performing a misfire suppression processing (e.g., control of the refiring for the engine cylinder in which the misfire took place) on the basis of a misfire detection signal which is generated when the detected ion current value I indicates a misfire level. As the engine control parameter Ta, not only the ignition timing but also other various parameters such as the fuel injection timing, the ignition coil on/off timing, etc., can be mentioned.

FIG. 4 is a circuit diagram showing a circuit configuration of the ion current detecting means 20. As can be seen from this figure, the ion current detecting means or circuit 20 is constituted by an ignition coil 21 having a primary winding 21*a* and a secondary winding 21*b*, a power transistor 22 for breaking a primary current $i_1$ flowing through the primary winding 21*a* in response to a firing pulse (ignition trigger pulse) P generated with an ignition timing, a spark plug 23 connected to the secondary winding 21*b* for producing a spark through an electric discharge brought about by a high voltage induced in the secondary winding 21*b*, a DC power supply source 24 for drawing as an ion current i those ions which are produced by the explosive combustion primed by the spark discharge in the spark plug 23, a resistor 25 inserted between the DC power supply source 24 and the secondary winding 21*b* for converting the ion current i into a voltage signal and an output terminal 26 for outputting the voltage signal (hereinafter also referred to as the ion current signal) indicative of the ion current I.

The DC power supply source 24, the resister 25 and the output terminal 26 provided at the secondary side of the ignition coil 21 constitutes the ion current detecting means 20A (FIG. 3) for producing the ion current signal I detected the associated engine cylinder. Further, the DC power supply source 24 serves as a voltage source for applying constantly a bias voltage of a positive or plus polarity to the spark plug 23.

FIG. 5 is a waveform diagram showing a waveform of the ion current i. As can be seen from this figure, the ion current (of negative or minus polarity) i assumes a maximum level in the vicinity of the crank angle of A10° (10° after the top dead center) in succession to the explosion triggered by the spark discharge produced at the ignition plug 23 upon breaking of the primary current $i_1$ in response to the firing pulse P. Parenthetically, it should be mentioned that noise of about three times as high an amplitude as the maximum ion current level is usually produced due to inductance of the secondary winding 21*b* of the ignition coil immediately after breakage of the primary current $i_1$. This noise is eliminated through a fly-wheel diode (not shown) connected across the secondary winding 21*b*.

Now, description will be made of the operation of the engine control apparatus shown in FIG. 3 by reference to FIGS. 4 and 5.

Usually, the engine control parameter setting means 31 sets the ignition timing (i.e. the time point for ignition) with reference to the reference position which corresponds to a rising edge or a falling edge of the reference position signal $T\theta$ and determines the ignition timing so as to be optimal for the prevailing engine operation state represented by the signal D by consulting a data map or table, to thereby output as the control parameter Ta a control time or period which is to intervene between the reference position and the firing time point.

On the other hand, the misfire detecting circuit incorporated in the control parameter setting means 32 determines the combustion state within the associated engine cylinder in each ignition cycle on the basis of the reference position signal $T\theta$ and the detected ion current signal I, to thereby generate a misfire detection signal for the associated cylinder when the detected ion current signal I produced immediately after the explosion stroke is lower than a predetermined reference level (ordinarily set in correspondence to the maximum level). The engine control parameter setting means 31 responds to the misfire detection signal to thereby correct the control parameter Ta for the engine cylinder misfired so that any further occurrence of misfire in that cylinder can be suppressed. To this end, the ignition control may be performed again or alternatively the ignition energy may be increased by elongating the period of electrical conduction of the primary current $i_1$ through the primary winding 21*a* of the ignition coil 21. Further, when the fuel injection control is performed to the same end, the injection period may be increased to enrich appropriately the air-fuel mixture. In case the misfire susceptibility is not yet improved by the correction of the control parameter Ta as mentioned above, fuel injection to the engine cylinder suffering the misfire is stopped to thereby prevent the discharge of the uncombusted gas for protecting the catalyst against injury.

In general, when the power transistor 22 is turned off in response to the firing pulse P in the ignition cycle, a high voltage of negative polarity is applied across the spark plug 23 connected to the secondary winding 21*b* of the ignition coil 21, as a result of which an electric discharge takes place between a pair of electrodes of the spark plug 23 to fire the gas mixture which then undergoes an explosive combustion. At this time, ions are produced within the engine cylinder due to ionization taking place in accompanying the explosive combustion. After the explosion, the spark plug 23 to which a bias voltage is applied from the DC power supply source 24 serves as electrode means for detecting the ion current i.

The electrons within the engine cylinder resulting from the ionizations are caused to migrate under the effect of the electric field of the bias voltage of positive polarity supplied from the DC power supply source 24, thereby giving rise to the ion current i, which is then converted to the voltage signal by the resistor 25 to be outputted from the output terminal 26 as the ion current signal I. Thus, it is possible to make decision as to whether or not the combustion has taken place in the engine cylinder in the ignition cycle by checking the level of the ion current signal I.

In this conjunction, it is however noted that not a little difficulty is encountered in making decision as to whether the misfire as detected is ascribable to a malfunction of the ignition coil 21 or that of the ignition plug 23. In this conjunction, there has already been proposed an arrangement in which a circuit (not shown) for detecting the primary current $i_1$ of the ignition coil is provided, wherein so long as the primary current $i_1$ of a magnitude greater than a predetermined value is detected, decision is made that the ignition coil 21 operates normally. However, with such arrangement, abnormality at the secondary side of the ignition coil 21 can not be detected notwithstanding of the fact that the secondary current $i_2$ actually partakes in the ignition, which in turn means that the decision made with the aid of the arrangement mentioned above is poor in reliability.

SUMMARY OF THE INVENTION

As is apparent from the above elucidation, the engine control apparatus known heretofore lacks a means for detecting the abnormality of the ignition coil with high reliability and thus suffers from a problem that proper measures can not be taken upon occurrence of misfire because of poor reliability of the abnormality decision.

It is therefore an object of the present invention to provide an engine control apparatus which is capable of diagnosing the ignition coil and deciding abnormality thereof, if occurred, with a high degree of reliability by resorting to a simple and inexpensive hardware structure, to thereby eliminate the drawback which the engine control apparatus known heretofore suffers.

In view of the above and other objects which will become more apparent as description proceeds, there is provided according to an aspect of the present invention a control apparatus for an internal combustion engine which comprises angular position detecting means for generating a reference position signal corresponding to a predetermined crank angle of an engine cylinder in synchronism with the rotation of the engine, sensor means for acquiring running state information of the engine, an ignition coil having a primary winding and a secondary winding to which an spark plug of the associated engine cylinder is connected, ion current detecting means connected to the secondary winding of the ignition coil for detecting an ion current generated within the engine cylinder in each combustion cycle thereof and outputting a corresponding ion current signal, control parameter setting means for setting a control parameter of the engine on the basis of the reference position signal and the engine running state information and for correcting the control parameter on the basis of the ion current signal, initial current value hold means for holding an initial level of the ion current signal as detected, and ignition coil diagnosis means for generating an abnormality signal indicating occurrence of abnormality in the ignition coil on the basis of the initial level of the ion current signal, wherein the control parameter setting means validates a function for protecting the engine on the basis of the abnormality signal.

According to the teaching of the invention incarnated in the structure of the engine control apparatus described above, the noise generated in an initial phase of the explosive combustion is not eliminated but made use of rather positively for producing an ignition coil abnormality decision signal in dependence on the initial level of the ion current signal. The control parameter setting means then responds to the abnormality decision signal to thereby take the appropriate measure for protecting the engine. In this way, more positive protection can be assured for the engine.

The above and other objects, features and attendant advantages of the present invention will be more apparent by reading the following description taken in conjunction with preferred or exemplary embodiments thereof by reference to the drawings.

DESCRIPTION OF THE PREFERRED EMBODIMENTS

Now, the present invention will be described in detail in conjunction with preferred or exemplary embodiment thereof by reference to the drawings.

Figure 1:
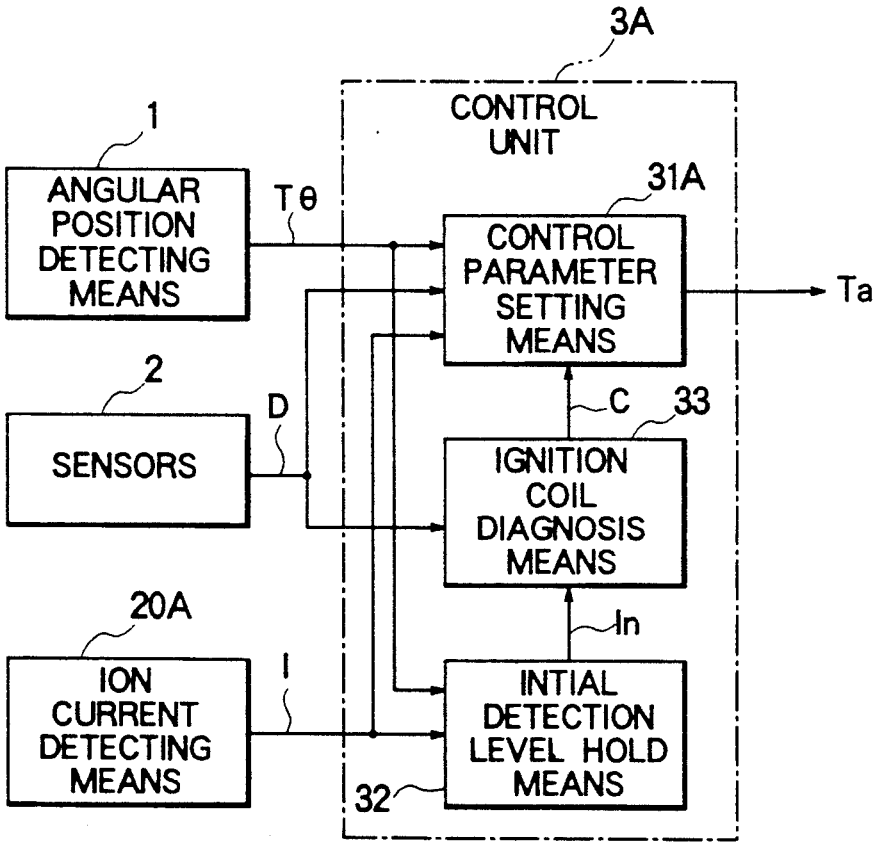
FIG. 1 is a functional block diagram showing schematically and generally an arrangement of an engine apparatus according to an embodiment of the present invention.
Figure 3:
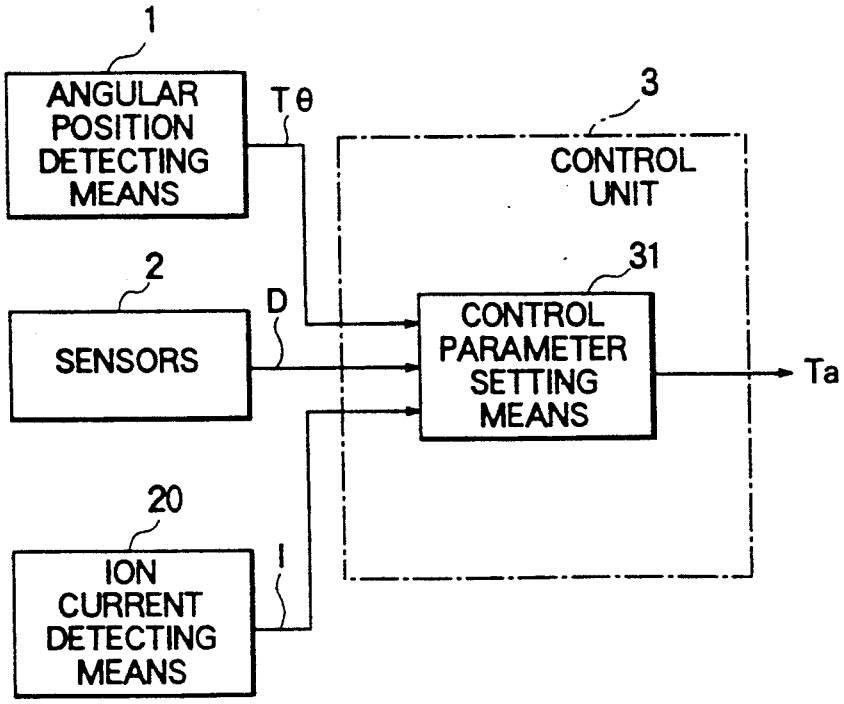
FIG. 3 PRIOR ART
FIG. 3 is a functional block diagram showing generally a structure of an engine control apparatus known heretofore.

FIG. 1 is a functional block diagram generally showing the arrangement of an engine control apparatus according to an embodiment of the present invention. In the figure, reference symbols 3A and 31A denote a control unit and an engine control parameter setting means which correspond, respectively, to the control unit 3 and the engine control parameter setting means 31 described hereinbefore by reference to FIG. 3. Further, an angular position detecting means 1 and various sensors 2 are the same as or equivalent to those designated by like reference numerals in FIG. 3 and described hereinbefore in conjunction with the related art of the invention. Accordingly, a repeated description thereof will be unnecessary.

Figure 4:
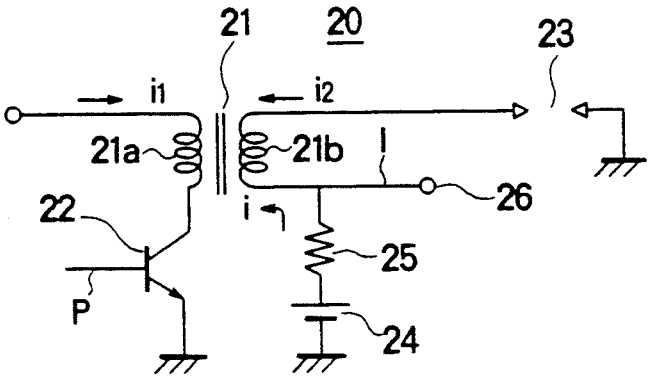
FIG. 4 is a circuit diagram showing a configuration of an ion current detecting circuit.
Figure 5:
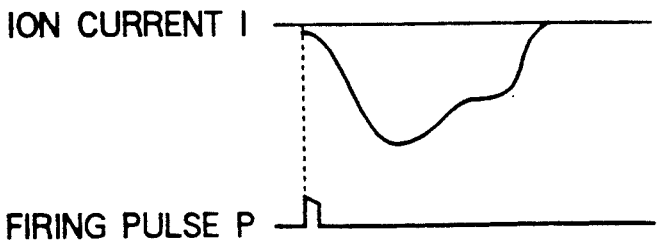
FIG. 5 is a waveform diagram showing a typical waveform of an ion current.

An ion current detecting means 20A is implemented in the circuit configuration shown in FIG. 4 and described hereinbefore. It should however be noted that according to the invention, the fly-wheel diode is not provided across the secondary winding **21*b* of the ignition coil 21** in contrast to the conventional ion current detecting circuit in which the fly-wheel diode is connected in parallel to the secondary winding for the purpose of noise elimination, as mentioned previously.

Referring to FIG. 1, the control unit 3A according to the present invention includes, in addition to the control parameter setting means 31A, an initial current value hold means 32 for holding an initial detection level In of a detected ion current and an ignition coil diagnosis means 33 for producing an abnormality decision signal C indicating abnormality of the ignition coil 20 (FIG. 4) in dependence on the detected initial detection level In.

The control parameter setting means 31A determines abnormality of the ignition coil 20 on the basis of the abnormality decision signal C to thereby take the appropriate measures such stoppage of the fuel injection to the associated cylinder or the like so that the misfire is suppressed.

Figure 2:
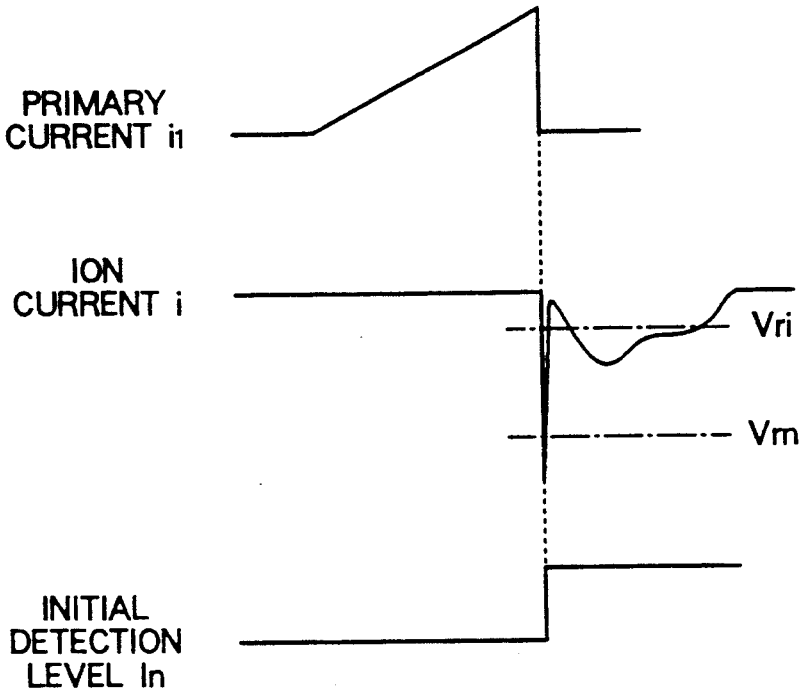
FIG. 2 is a waveform diagram for illustrating operation of the engine control apparatus shown in FIG. 1.

FIG. 2 is a waveform diagram showing typical waveforms of the primary current i of the ignition coil 21, the ion current i and the initial detection level In, respectively. In the figure, a symbol Vri designates a reference value (on the order of 5 V) of the ion current level which is referenced for confirming the ignition and combustion, while a symbol Vrn designates a reference value (on the order of 150 V) for the initial-phase noise current, which value is made use of for diagnosing the function of the ignition coil.

Next, operation of the engine control apparatus according to the instant embodiment of the invention will be described in detail by reference to FIG. 2 together with FIG. 1.

Normally, the control parameter setting means 31A is in charge of determining arithmetically the control time Ta on the basis of the reference position signal $T\theta$ and the engine running state information D and performs correction of the engine control parameter(s) Ta upon determination of occurrence of the misfire, which determination is made on the basis of the detected ion current I.

More specifically, when the detected ion current value I exceeds the reference value Vri upon lapse of a predetermined period after disappearance of the initial detection level In which makes appearance immediately following the firing, it is decided that combustion has taken place normally, and if otherwise, decision is made that misfiring has taken place.

A high voltage of negative polarity is applied across the spark plug 23 from the secondary winding **21*b* immediately after breakage of the current flowing through the primary winding 21*a* of the ignition coil 21. In this case, a voltage of positive polarity makes appearance at the spark plug due to inductance of the secondary winding 21*b*. Thus, a current is forced to flow through the secondary winding 21*b* via the resistor 25 from the DC power supply source 25 in the same direction as the ion current i, resulting in generation of about thrice as high a voltage signal I as the maximum value of the voltage signal representing the intrinsic ion current I from the output terminal 26**.

At this time point, the initial current hold means 32 holds a signal of level "H" as the initial detection level In when the initial-phase current value I detected immediately after the firing has attained or exceeded the reference value Vrn.

The ignition coil diagnosis means 33 fetches the initial detection level In after lapse of a predetermined time before the succeeding firing time point while resetting simultaneously the initial detection level In held by the detection value hold means 32, for thereby enabling succeeding detection of the initial current level In.

When the initial detection level In thus fetched indicates that the initial-phase noise exceeds the reference value Vrn, it is then determined that the ignition coil 21 operates normally. On the other hand, unless the initial detection level In as fetched indicates that the initial-phase noise has not reached the reference value Vrn, the abnormality decision signal C is generated and inputted to the control parameter setting means 31A.

In response to the input of the abnormality decision signal C, indicating occurrence of abnormality in the ignition coil 21, the control parameter setting means interrupts or stops the fuel injection to the cylinder misfired, for thereby preventing discharge of the uncombusted gas, because occurrence of the misfire can not be suppressed by the correction of the control parameter Ta when abnormality of the ignition coil is determined.

In this way, decision as to whether or not the misfire is ascribable to abnormality of the ignition coil 21 can be made on the basis of the detected ion current signal I through comparison with the reference value Vrn for the initial detection level In and the reference value Vri for detection of a maximum value of the intrinsic ion current value I. More specifically, so long as the initial-phase noise exceeds the reference level Vr with the initial detection level being set to "H" level, this means that the ignition coil suffers no abnormality. On this condition, when the intrinsic ion current i does not exceed the reference value Vri, this means that misfire has taken place due to abnormality in the spark plug. When abnormality of the ignition plug 23 is decided, appropriate measures such as increasing of the amount of fuel to be injected into the associated cylinder or the like is taken, while when abnormality of the ignition coil 21 is determined, other appropriate measures such as stoppage of the fuel injection to the associated cylinder is taken.

In this conjunction, it is noted that the level of the ion current signal I differs in dependence on the engine running states D. Consequently, reliability of misfire decision is low when only the reference value Vri is resorted to, as in the case of the conventional misfire detection apparatus. However, by taking into account the reference value Vrn for the initial detection level In in the misfire decision, the reliability thereof can significantly be enhanced notwithstanding of variance in the engine running states D. Besides, it should be noted that because the existing ion current detecting means 20A for detecting the combustion state can be employed for realizing the invention, any appreciable complication will not be involved in the hardware configuration.

In the case of the embodiment described above, the detection value holding means 32 is destined to hold the signal of level "H" as the initial detection level In, when the reference value Vrn is exceeded. However, the detection value holding means 32 may be so designed as to hold a peak level of the initial-phase noise. In that case, comparison of the initial-phase noise with the reference value Vrn may be performed by the ignition coil diagnosis means 33.

Although the DC voltage source 24 is used as a source for the ion current bias voltage, other bias means such as a capacitor or the like can equally be employed.

As will now be understood from the foregoing description, there has been provided according to the invention an engine control apparatus which can decide occurrence of abnormality in the ignition coil with a high reliability with a simple and inexpensive structure.

While the invention has been described in terms of its preferred embodiments, it should be understood that numerous modifications may be made thereto without departing from the spirit and scope of the invention as defined in the appended claims. It is intended that all such modifications fall within the scope of the claims.

What is claimed is:

1. A control apparatus for an internal combustion engine, comprising:

angular position detecting means for generating a reference position signal corresponding to a predetermined crank angle of an engine cylinder in synchronism with the rotation of said engine;

sensor means for acquiring running state information of said engine;

an ignition coil having a primary winding and a secondary winding to which a spark plug of the associated engine cylinder is connected;

ion current detecting means connected to the secondary winding of said ignition coil for detecting an ion current generated in said engine cylinder in each combustion cycle and outputting a corresponding ion current signal;

control parameter setting means for setting a control parameter of said engine on the basis of said reference position signal and said engine running state information and correcting said control parameter on the basis of said detected ion current;

detection level hold means for holding an initial level of said detected ion current signal; and ignition coil diagnosis means for generating an abnormality decision signal indicating occurrence of abnormality in said ignition coil on the basis of said initial level of said detected ion current signal;

wherein said control parameter setting means validates a function for protecting said engine in dependence on the output signal of said ignition coil diagnosis means.

2. An engine control apparatus according to claim 1, wherein said ignition coil diagnosis means compares initial-phase noise generated by the ignition coil upon breakage of a primary current thereof with a first reference level (Vrn), to thereby set said initial detection level to a first value indicating absence of abnormality in said ignition coil, when said initial-phase noise exceeds said first reference level (Vrn), while setting said initial detection level to a second value indicating abnormality of said ignition coil unless said initial-phase noise exceeds said first reference level (Vrn).

3. An engine control apparatus according to claim 2, wherein said control parameter setting means includes a misfire detecting means for comparing the ion current with a second reference level (Vri) to thereby produce a misfire signal indicating occurrence of misfire in the associated engine cylinder unless said ion current exceeds said second reference level (Vri).

4. An engine control apparatus according to claim 3, wherein said control parameter setting means stops fuel injection to the associated engine cylinder in response to the initial detection level of said second value.

5. An engine control apparatus according to claim 3, wherein said control parameter setting means corrects at least one of engine control parameters in response to the ion current of the level lower than said second reference level (Vrn).

6. An engine control apparatus according to claim 5, wherein said engine control parameters include a fuel injection timing, an ignition coil firing timing, an air-fuel ratio and a duration of electrical energization of the ignition coil.

* * * * *